US007938090B2

(12) United States Patent
Lancefield et al.

(10) Patent No.: US 7,938,090 B2
(45) Date of Patent: May 10, 2011

(54) VARIABLE PHASE MECHANISM

(75) Inventors: Timothy Mark Lancefield, Shipston on Stour (GB); Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 293 days.

(21) Appl. No.: 12/374,455

(22) PCT Filed: Jun. 1, 2007

(86) PCT No.: PCT/GB2007/050309

§ 371 (c)(1),
(2), (4) Date: Jan. 20, 2009

(87) PCT Pub. No.: WO2008/009983

PCT Pub. Date: Jan. 24, 2008

(65) Prior Publication Data

US 2009/0293826 A1 Dec. 3, 2009

(30) Foreign Application Priority Data

Jul. 20, 2006 (GB) ..... 0614397.8

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 3,516,394 | A | 6/1970 | Nichols | |
| 6,253,719 | B1 * | 7/2001 | Methley | 123/90.17 |

FOREIGN PATENT DOCUMENTS

| | | |
|---|---|---|
| EP | 0181079 | 5/1986 |
| EP | 1030035 | 8/2000 |
| GB | 2268245 | 1/1994 |
| GB | 2330894 | 5/1999 |
| GB | 2421557 | 6/2006 |

* cited by examiner

*Primary Examiner* — Ching Chang
(74) *Attorney, Agent, or Firm* — Chernoff, Vilhauer, McClung & Stenzel

(57) ABSTRACT

A variable phase mechanism is described which comprises a drive member rotatable about an axis, first and second driven members rotatable in synchronism with the drive member, an actuator for rotating the first driven member relative to the drive member to vary the phase of rotation of the first driven member relative to the drive member, and a yoke coupling the second driven member for rotation with one of the drive member and the first driven member and movable transversely relative to the axis of the drive member to vary the phase of rotation of the second driven member relative to the drive member. In the invention, transverse movement of the yoke is effected by means of interaction between the other of the drive member and the first driven member and a radially outwards facing surface defined by the yoke.

17 Claims, 13 Drawing Sheets

VARIABLE PHASE MECHANISM

This is a national stage application filed under 35 USC 371 based on International Application No. PCT/GB2007/050309 filed Jun. 1, 2007, and claims priority under 35 USC 119 of United Kingdom Patent Application No. 0614397.8 filed Jul. 20, 2006.

FIELD OF THE INVENTION

The invention relates to a variable phase mechanism which comprises a drive member rotatable about an axis, first and second driven members rotatable in synchronism with the drive member, means for rotating the first driven member relative to the drive member to vary the phase of rotation of the first driven member relative to the drive member, and a yoke coupling the second driven member for rotation with the drive member and movable transversely relative to the axis of the drive member to vary the phase of rotation of the second driven member relative to the drive member. Such a variable phase mechanism, also termed a phaser, is described in the Applicants' earlier patent application EP 1030035.

BACKGROUND OF THE INVENTION

The two driven members are especially suitable for connection to respective ones of the inner shaft and the outer tube of an assembled SCP (single cam phaser) camshaft. In such a camshaft, a first set of cam lobes is mounted for rotation with the outer shaft and a second set of cam lobes is freely rotatable relative to the outer tube but connected for rotation with the inner shaft by pins that pass with clearance through tangentially elongated slots in the outer tube. In this way, the invention enables the timing of both the inner shaft and outer tube of the camshaft to be changed relative to the crankshaft using only a single actuator and control system. This offers a high level of valve timing flexibility at a considerably reduced cost, when compared to an engine with two fully independent phasing systems.

OBJECT OF THE INVENTION

The present invention seeks to provide an improvement of the variable phase mechanism of EP 1030035 which reduces the complexity of the components in the assembly.

SUMMARY OF THE INVENTION

In accordance with the present invention, there is provided a variable phase mechanism, comprising a drive member rotatable about an axis, first and second driven members rotatable in synchronism with the drive member, means for rotating the first driven member relative to the drive member to vary the phase of rotation of the first driven member relative to the drive member, and a yoke coupling the second driven member for rotation with one of the drive member and the first driven member and movable transversely relative to the axis of the drive member to vary the phase of rotation of the second driven member relative to the drive member, wherein transverse movement of the yoke is effected by means of interaction between the other of the drive member and the first driven member and a radially outwards facing surface defined by the yoke.

In this way, the position of the first driven member relative to the drive member determines the position of the yoke and thereby causes the second driven member to rotate relative to the drive member.

The yoke in the present invention is moved by control elements that act on a contoured radially outward facing surface of the yoke rather than using pads that are retained in the front section of the camshaft as described in EP 1030035. It is this approach which significantly reduces the design complexity of the components in the assembly.

For compactness, it is preferred to use hydraulically operated vanes movable in arcuate working chambers as the means for rotating the first driven member relative to the drive member. However as the invention is primarily concerned with the movement of the yoke which varies the phase of the second driven member, the means used for varying the phase of the first driven member is not of fundamental importance.

When applied to an SCP camshaft, the first driven member may directly control the timing of the inner drive shaft of an SCP camshaft and its associated cam lobes, while the second driven member may control the timing of the outer tube and its associated cam lobes.

In a further embodiment of the invention, the same type of variable phase mechanism may be used in an engine having two camshafts, the first driven by the crankshaft and the second driven by the first via a secondary drive. In this case, the first driven member controls the timing of the first camshaft, whilst the second driven member controls the timing of the second camshaft.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

Figure 1:
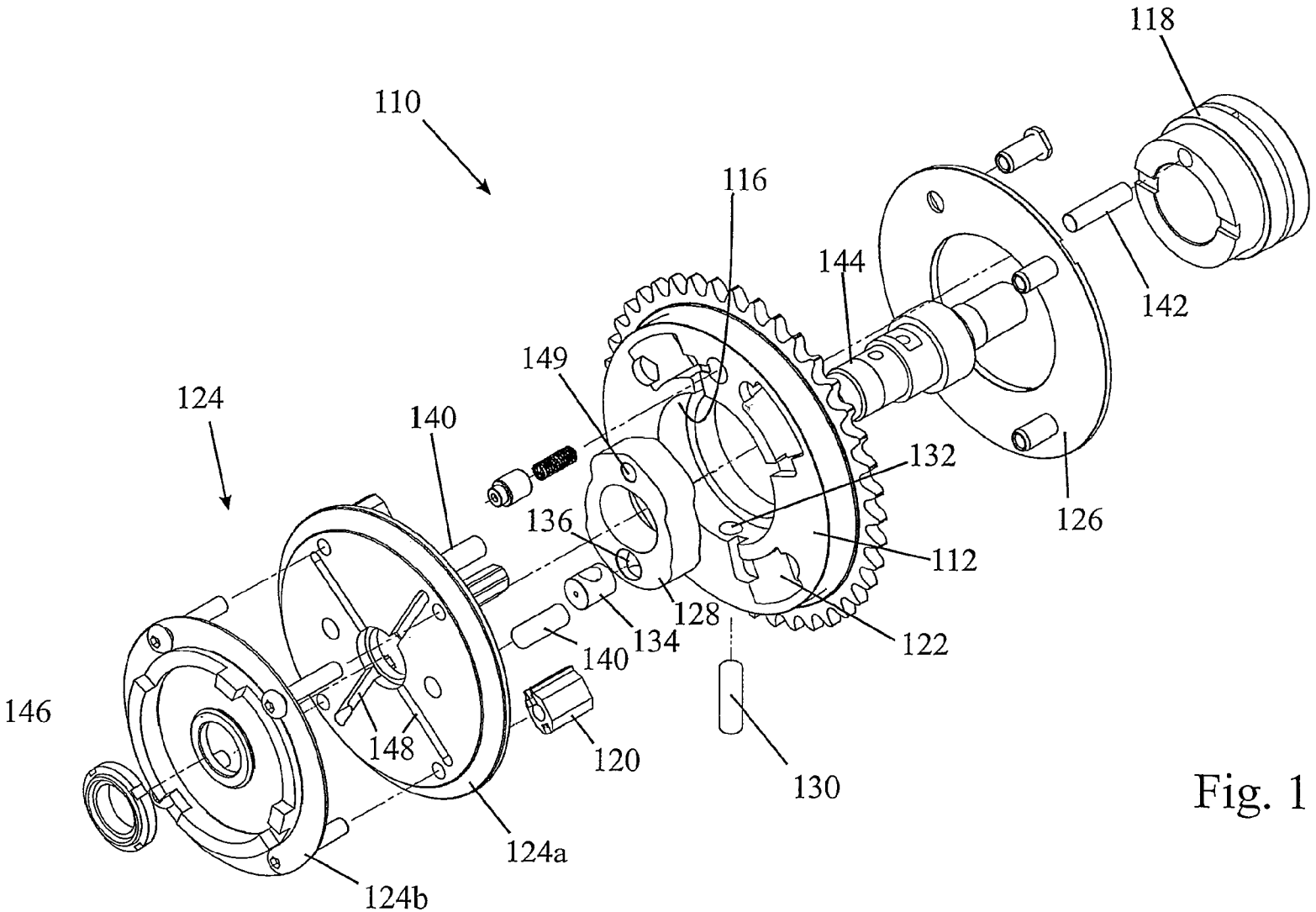
FIG. 1 is an isometric exploded view of a phaser in accordance with a first embodiment of the invention.

Throughout the drawings, like components have been designated by similar reference numerals in order to avoid unnecessary repetition of their description. To distinguish between the different embodiment, the reference numerals of the first described embodiment are in the "100" series, those of the second embodiment in the "200" series and so on. It is therefore identity of the last two digits of each reference numeral that indicates like components.

The components in the variable phase mechanism, or phaser, of the first embodiment of the invention are shown in the exploded view of FIG. 1. The phaser 110 has a drive member 112 driven by the crankshaft via a chain engaging sprocket teeth 114. The drive member 112 has a central bore 116 supported by a front bearing 118 of the camshaft—shown in FIG. 2A and on the far right in FIG. 1. The phaser is a vane-type phaser having vanes 120 which pass through arcuate cavities 122 in the drive member 112 and secured at their opposite axial ends to front and rear closure plates 124 and 126. The phaser design is generally similar to that shown in GB 2421557, which is incorporated herein by reference.

A yoke 128 is located inside the drive member 112 behind the front plate 124 of the phaser and is connected to the drive member 112 by a pin 130 which is fixed into a radial bore 132 and engages in a fulcrum pin 134 that fits rotatably into an axially extending bore 136 in the yoke. This linkage allows the yoke 128 to rotate about a pin 142 connecting it with the front camshaft bearing 118 and to take up an eccentric position. The yoke 128 is positioned by two pins 140 that are fixed into the front plate 124 of the phaser and engage with the contoured outer profile of the yoke 128. The profile on the radially outer surface of the yoke 128 causes it to rotate as the two pins 140 in the front plate 124 of the phaser rotate with the vanes 120.

The outer tube of the SCP camshaft is not shown in FIG. 1, but would be driven via the front bearing journal 118 of the camshaft, shown on the far right. The front bearing 118 is driven by the yoke 128 via a connecting pin 142 shown adjacent to the bearing 118 in FIG. 1. The inner drive shaft of the SCP camshaft would be driven via a threaded shaft 144 that passes through the centre of the phaser 110 and is secured to the front plate 124 of the phaser via a nut 146.

The front plate of the phaser is formed of two parts 124*a*, 124*b* in order to simplify the oil distribution within the phaser, although a single part with complex oil drillings could be used. The inner part 124*a* contacts the ends of the vanes 120 and acts to seal the front of the cavities 122 in the drive member, while the outer part 124*b* acts to seal oil distribution slots that are formed in the inner part 124*a*. The outer part 124*b* also has the required timing features for a sensor to detect the position of the phaser during operation. Four vane fixings and the central drive shaft nut 146 all act to clamp the two parts together.

Figure 2D:
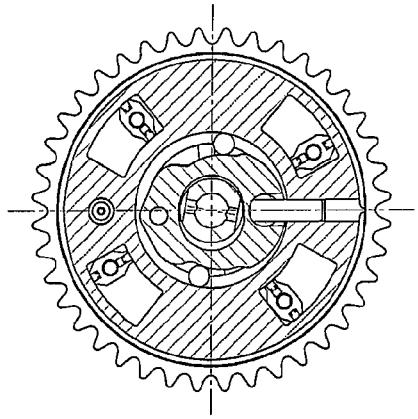
FIGS. 2B, 2C and 2D are transverse sections through the phaser in different settings of the phases of the driven members.
Figure 2C:
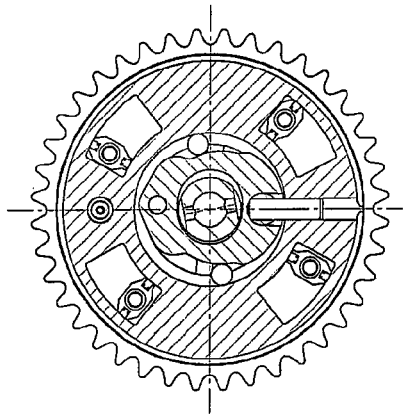
Figure 2B:
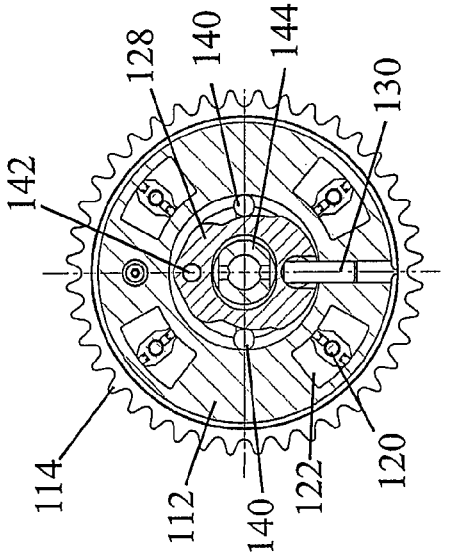
Figure 2A:
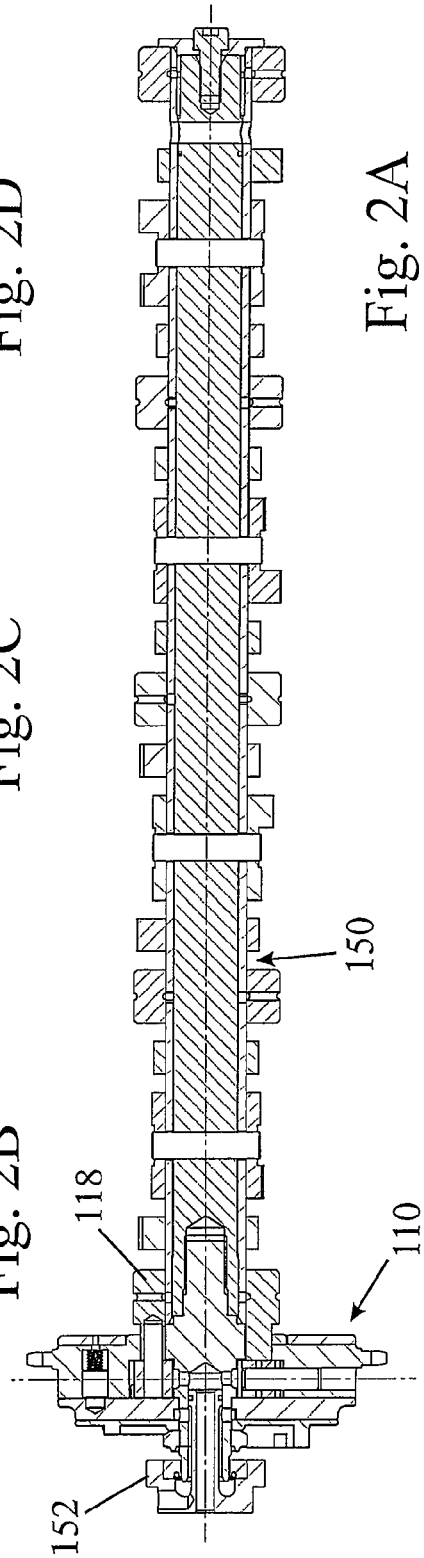
FIG. 2A is an axial section showing the phaser of FIG. 1 mounted on an SCP camshaft.
Figure 3:
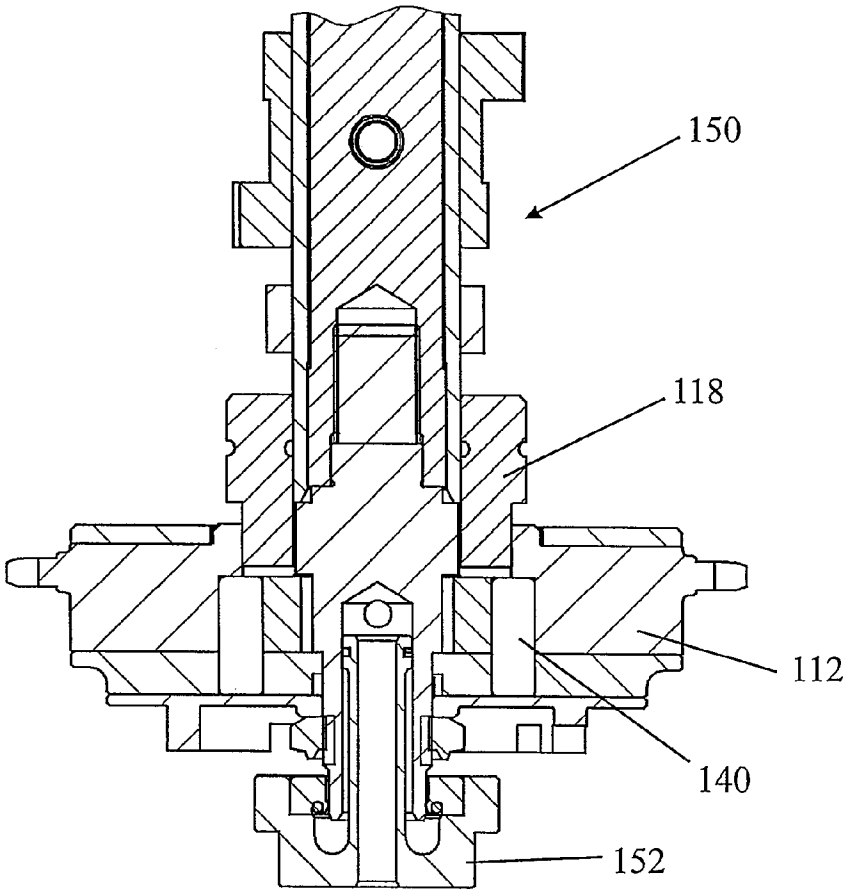
FIG. 3 is an axial section of the phaser of FIG. 2 in a perpendicular section plane.

FIGS. 2A and 3 show the phaser 110 assembled to an SCP camshaft 150, together with a spigot 152 for supplying oil to control the vane type phaser. The spigot 152 is conveniently assembled into the front cover of the engine which may also contain the hydraulic control valve for the phaser.

FIGS. 2B, 2C and 2D show the same section of the phaser in three different positions. In FIG. 2B, corresponding to mid-range, the yoke 128 is in a concentric position, whereas in FIGS. 2C and 2D the vanes 120 are fully retarded and fully advanced, respectively. It can be seen that the upper hole in the yoke 28, receiving the pin 142 which is connected to the front bearing of the camshaft 50, moves around the camshaft centre in the opposite direction to the vanes 120 and also moves through a different angle from the vanes 120.

Although the phaser 110 as shown illustrates the yoke 128 causing the camshaft outer tube to rotate in the opposite direction to its inner shaft, it is possible for the profile of the radially outer surface of the yoke 128 to be changed such that the two camshaft parts rotate in the same direction but by different amounts. The movement of the two phaser outputs may have a linear or non-linear relationship, but there can only be one yoke position for a given vane position.

FIG. 3 shows a section through the phaser in which the section plane passes through the pins 140 that act on the contoured outer profile of the yoke 128.

FIG. 4 shows two ways by which the design may be modified to improve the contact between the contoured outer profile of the yoke and the pins fitted to the front plate of the phaser. In the embodiment of FIGS. 4A and 4B, a sleeve 240*a* is fitted to the pins 240 such that as the pins move relative to the yoke 228, the sleeve 240*a* will roll across the profile of the yoke 228 reducing friction and wear. The use of graded sleeves 240*a* to eliminate any clearance in the yoke mechanism is also possible to mitigate the effects of component tolerance variations.

Figure 4C:
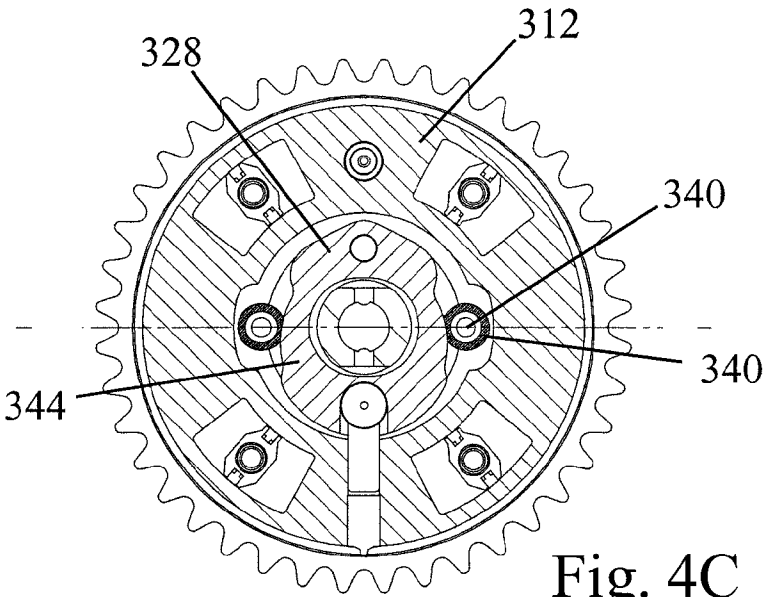
FIGS. 4C and 4D are views similar to FIGS. 2B and 3 showing a further possible modification of the pins.
Figure 4D:
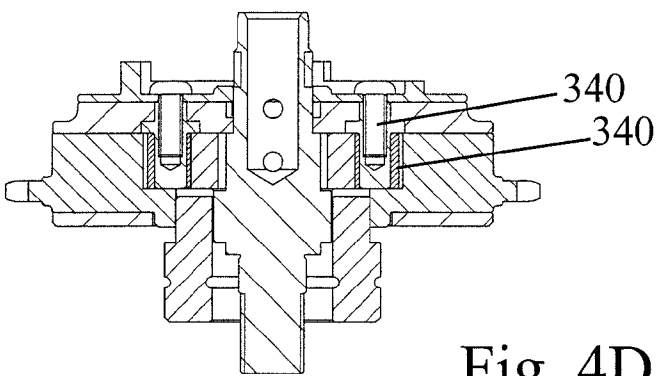
Figure 4A:
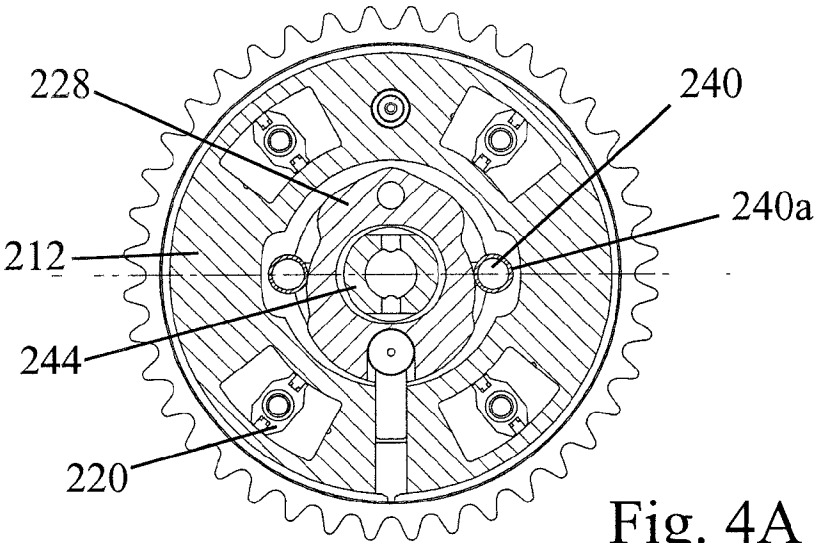
FIGS. 4A and 4B are views similar to FIGS. 2B and 3 showing a modification of the pins.
Figure 4B:
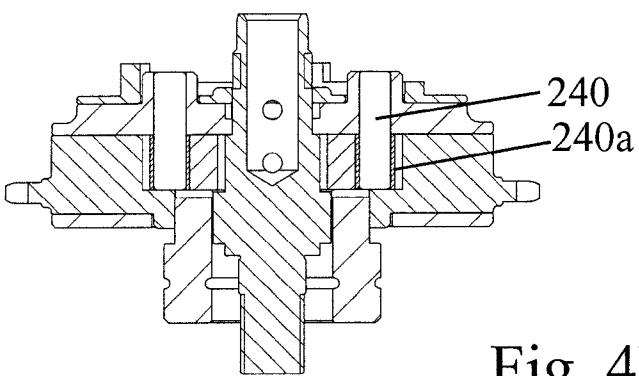

In FIGS. 4C and 4D, the sleeves are replaced by sliding pads 340*a* that are free to rotate on the pins 340 and have a profiled surface that matches with the profile of the radially outer surface of the yoke 328. This will significantly reduce the contact stress on the outside of the yoke 328, but requires the yoke to have a profile with constant curvature. Using a yoke profile with constant curvature restricts the yoke motion to having an almost linear relationship to the motion of the vanes.

Figure 5:
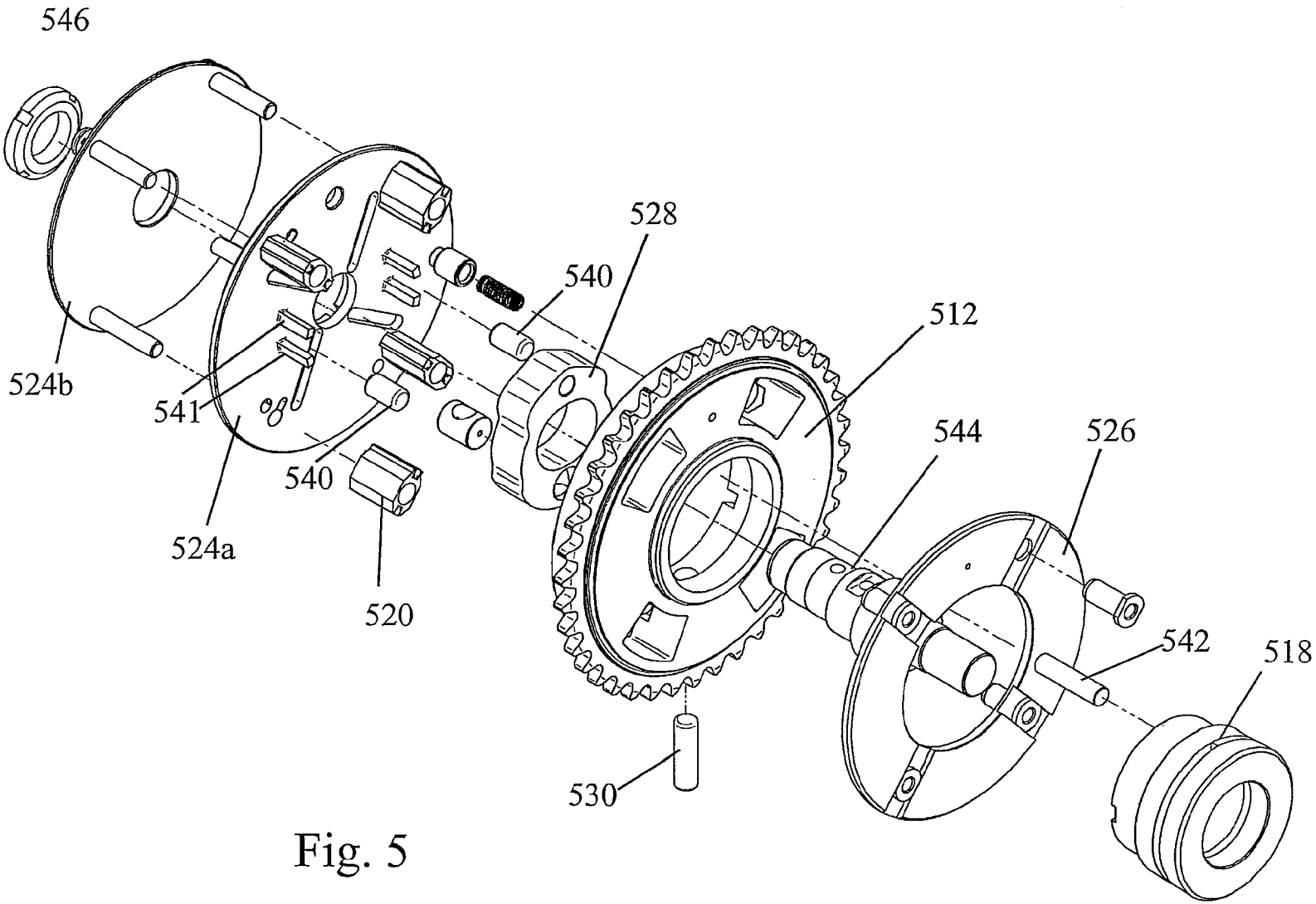
FIG. 5 is an exploded isometric view of a further embodiment of the invention in which rollers are used to change the position of the yoke.
Figure 6A:
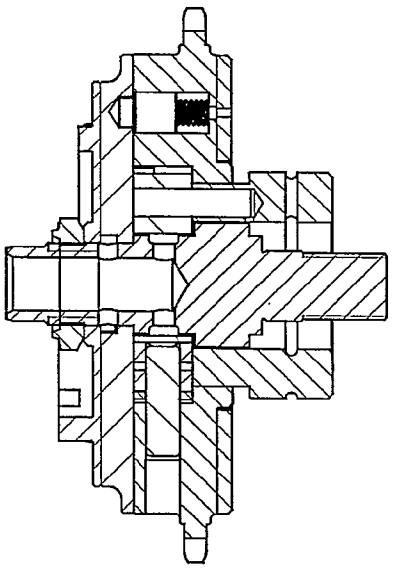
FIGS. 6A, 6B and 6*c* are sections in similar planes to those of FIGS. 2A, 2B and 2C through the embodiment of the invention shown in FIG. 5, FIGS. 7A, 7B, and 7C, are similar to FIGS. 6A, 6B and 6C but show an embodiment in which the yoke has a cylindrical outer surface and a profiled inner surface is provided on the drive member.
Figure 6C:
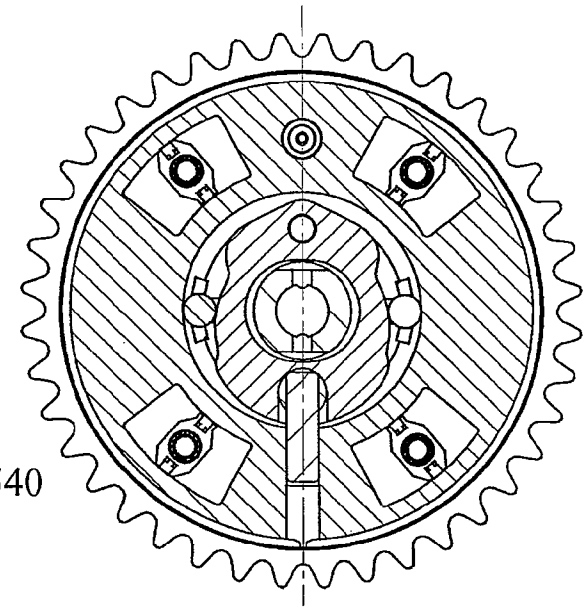
Figure 6B:
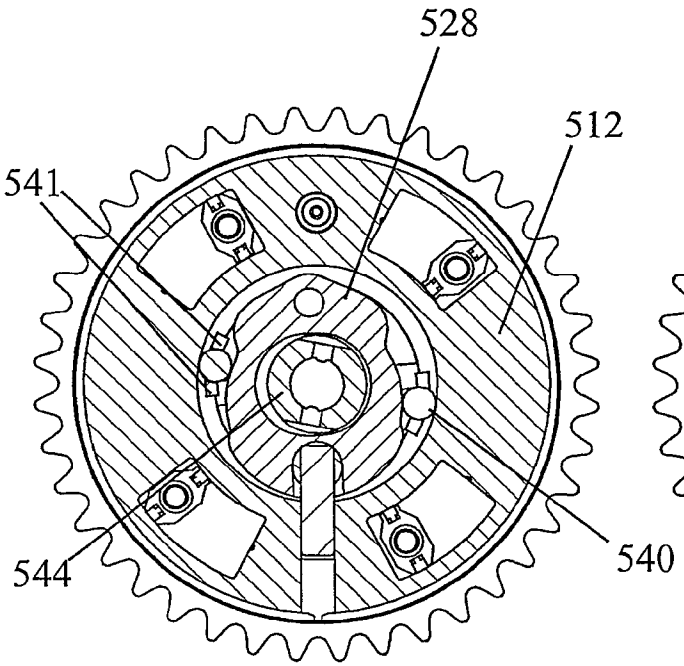

A further possibility is shown in FIGS. 5 and 6 where the pins contacting the radially outer surface of the yoke are replaced by a pair of rollers 540 that contact both the radially outer surface of the yoke 528, and the inside of the drive member. These rollers 540 are positioned by pairs of prongs 541 or similar features connected to the front plate 524 of the phaser, so that as the front plate 524 of the phaser rotates relative to the drive member 512, the prongs 541 that engage with the two rollers 540 cause the rollers to move around the radially outer surface of the yoke, causing the yoke to move across the axis of the phaser and rotate the front bearing 518 of the camshaft.

Figure 7A:
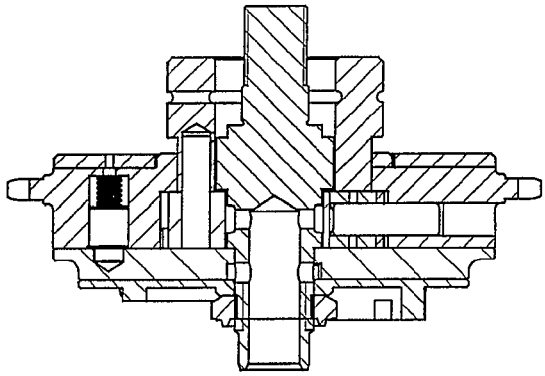
Figure 7C:
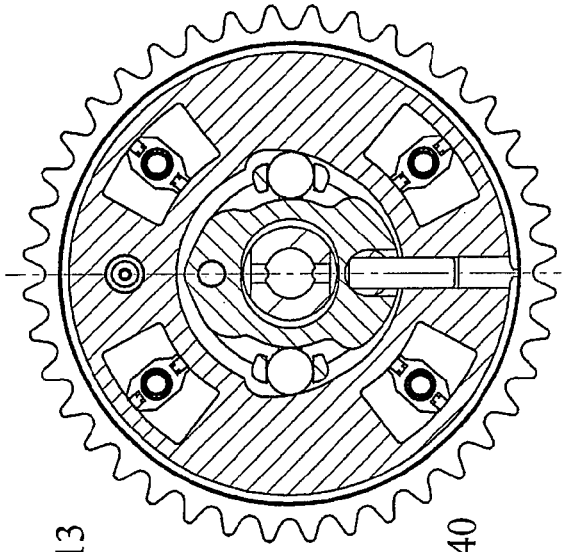
Figure 7B:
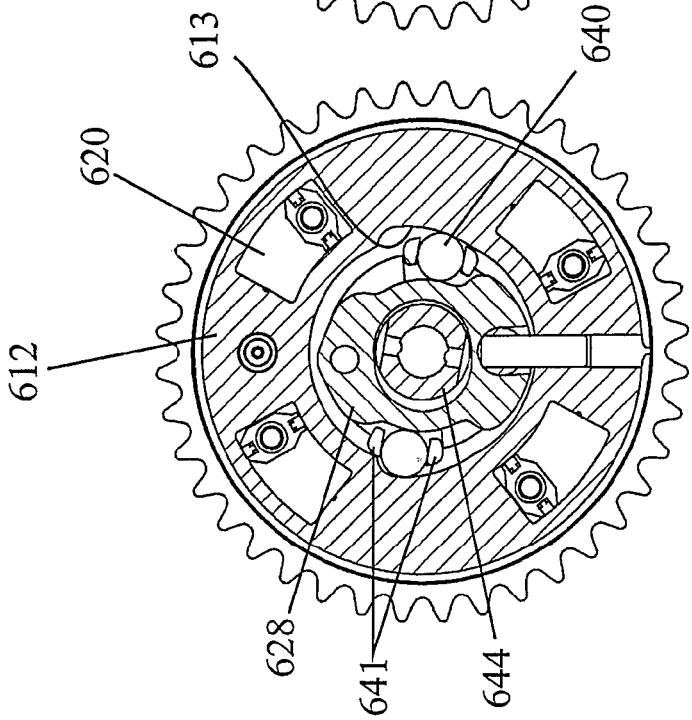

The sixth embodiment of the invention, shown in section in FIG. 7, differs from that of FIG. 6 in that the section of the outer surface of the yoke 628 in contact with the rollers 640 is essentially cylindrical and it is the inner surface 613 of the drive member 612 that is contoured to move the yoke 628 from side to side.

Figure 8:
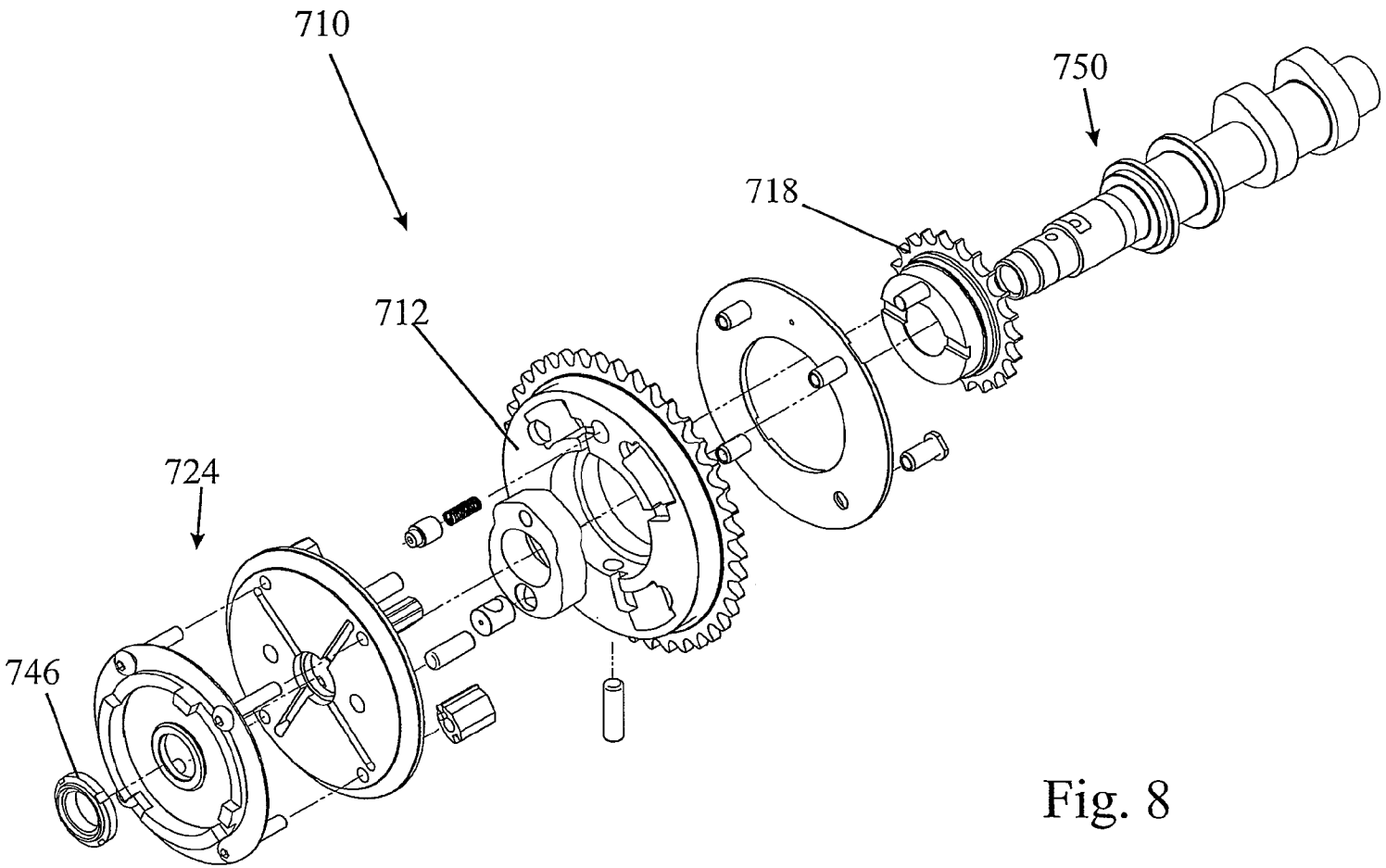
FIG. 8 is an exploded isometric view of a further embodiment of the invention designed for use in an engine with two separate camshafts.
Figure 9B:
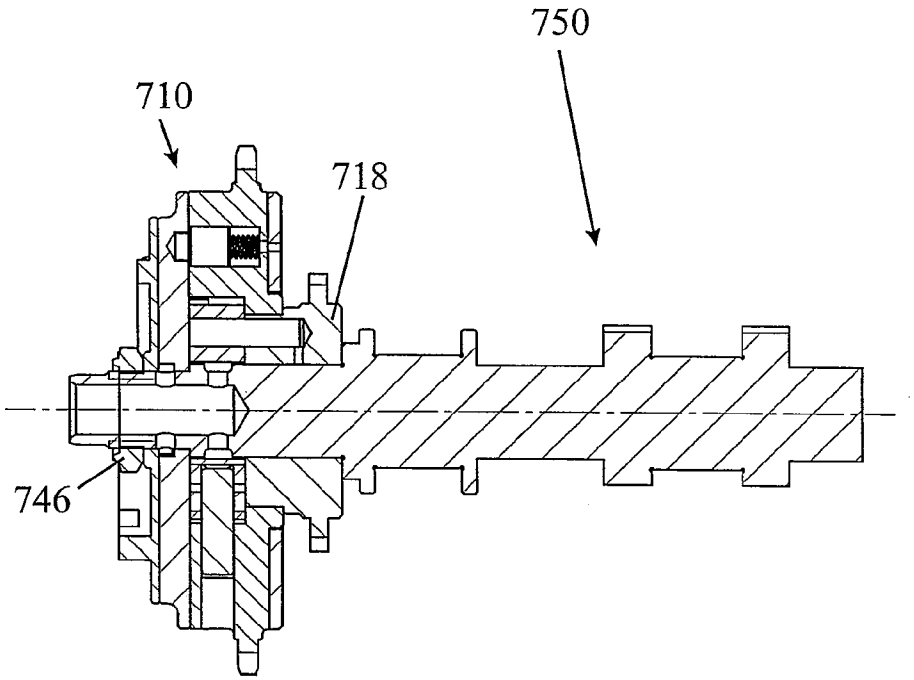
FIGS. 9A and 9B are a front view an axial section of the embodiment of FIG. 8.
Figure 9A:
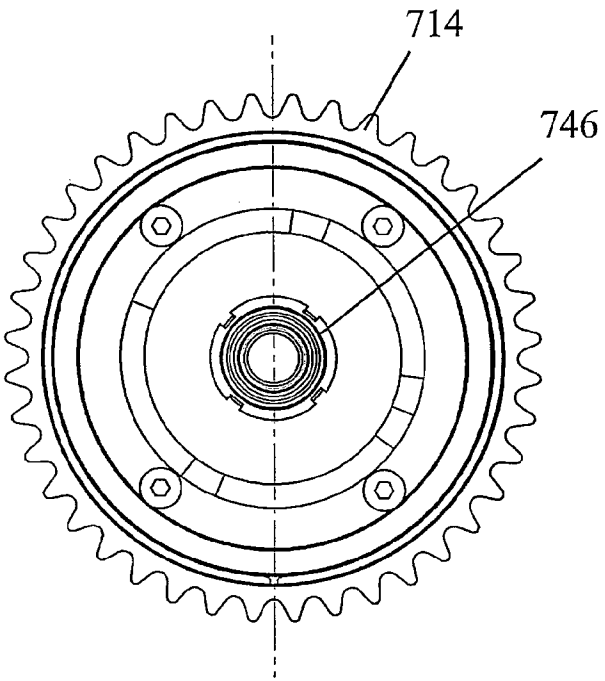

The embodiment of the invention shown in FIGS. 8, 9A and 9B is one designed for use in engine having twin camshafts, the first being driven by the crankshaft, whilst the second is driven from the first via a secondary gear or chain sprocket.

In this embodiment, the front bearing component of the previous embodiments that is driven by the yoke is replaced by the secondary drive sprocket 718. The sprocket is free to rotate on the outside of the camshaft 750 and the phaser 710 is mounted for rotation on the outside of the sprocket. The camshaft 750 is driven by the front plate 724 of the phaser and is connected by the phaser securing nut 746.

While in all the embodiments described above the yoke is pivotably mounted on the drive member and is caused to move between concentric and eccentric positions by interaction between a radially outwards facing surface of the yoke and the first driven member, it is possible to mount the yoke for pivotal movement relative to the first driven member and to cause it to move from side to side by interaction between a radially outwards facing surface on the yoke and the drive member. In this case, the phasing effect of the yoke one the second driven member is superimposed on phasing of the first driven member.

An embodiment of the invention operating in this manner is shown in FIGS. 10, 11A, 11*b* and 11C. Here, the yoke 828 forms a driving connection between the front plate 824 of the phaser, which is the first driven member, and the front bearing 818 of an SCP camshaft whilst a pair of cylindrical rollers 840 are located in the drive member 812 of the phaser to act on the outside profile of the yoke. The yoke in this case is supported on a pin 830 which engages with the front plate 824 and within a slide block 832 received within a slideway 834 in the yoke 828.

As the front plate 824 of the phaser 810 is rotated relative to the drive member 812, the yoke 812 rotates with it causing the rollers in the drive member to move around the outside of the yoke. The action of the rollers causes the yoke to move across the axis of the phaser and this causes a further phasing of the front bearing of the SCP camshaft relative to the front plate of the phaser.

Figure 11A:
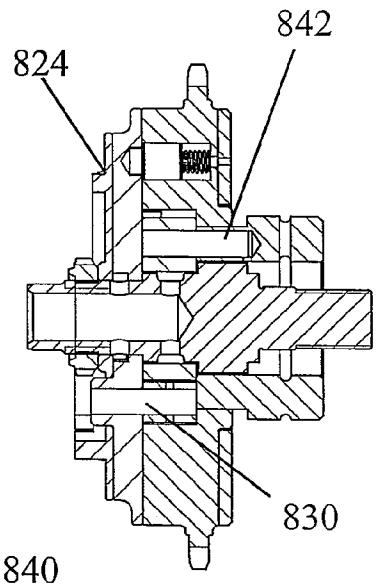
FIG. 11A is an axial section through the embodiment shown in FIG. 10, FIGS. 11B and 11C are transverse sections through the phaser of FIG. 10 in different positions of the driven members.
Figure 11C:
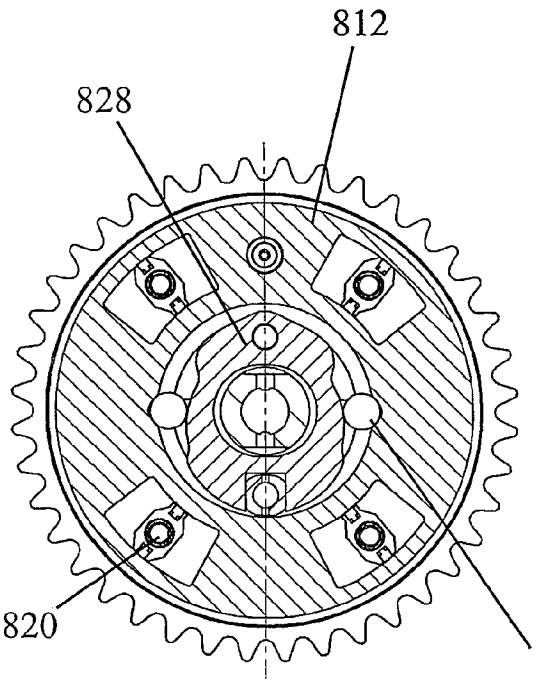
Figure 11B:
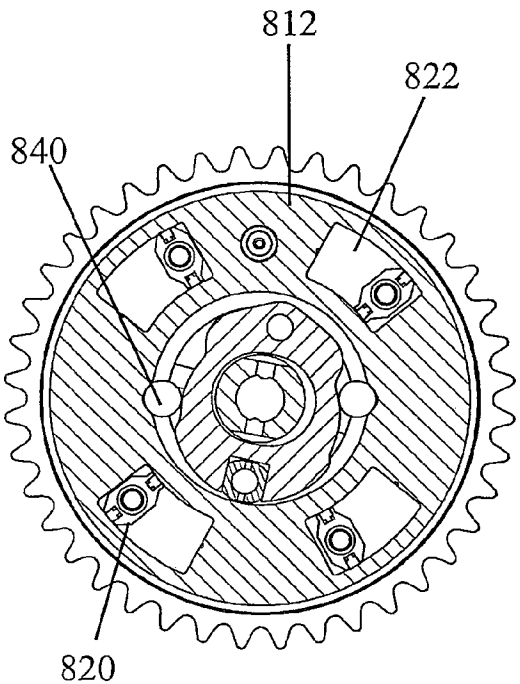

The view of FIG. 11C shows the yoke in the middle of the phaser operating range whilst FIG. 11B the position of the yoke 828 when the vanes 820 are fully advanced. FIG. 11A shows the connecting pins 830 and 842 that link the yoke 828 to the front plate 824 of the phaser and the front bearing 818 of the SCP camshaft, respectively. The whole phaser assembly is completely interchangeable with that shown in FIGS. 1 to 7, and the same principle could be applied to the twin cam arrangement of FIGS. 8 and 9.

Figure 10:
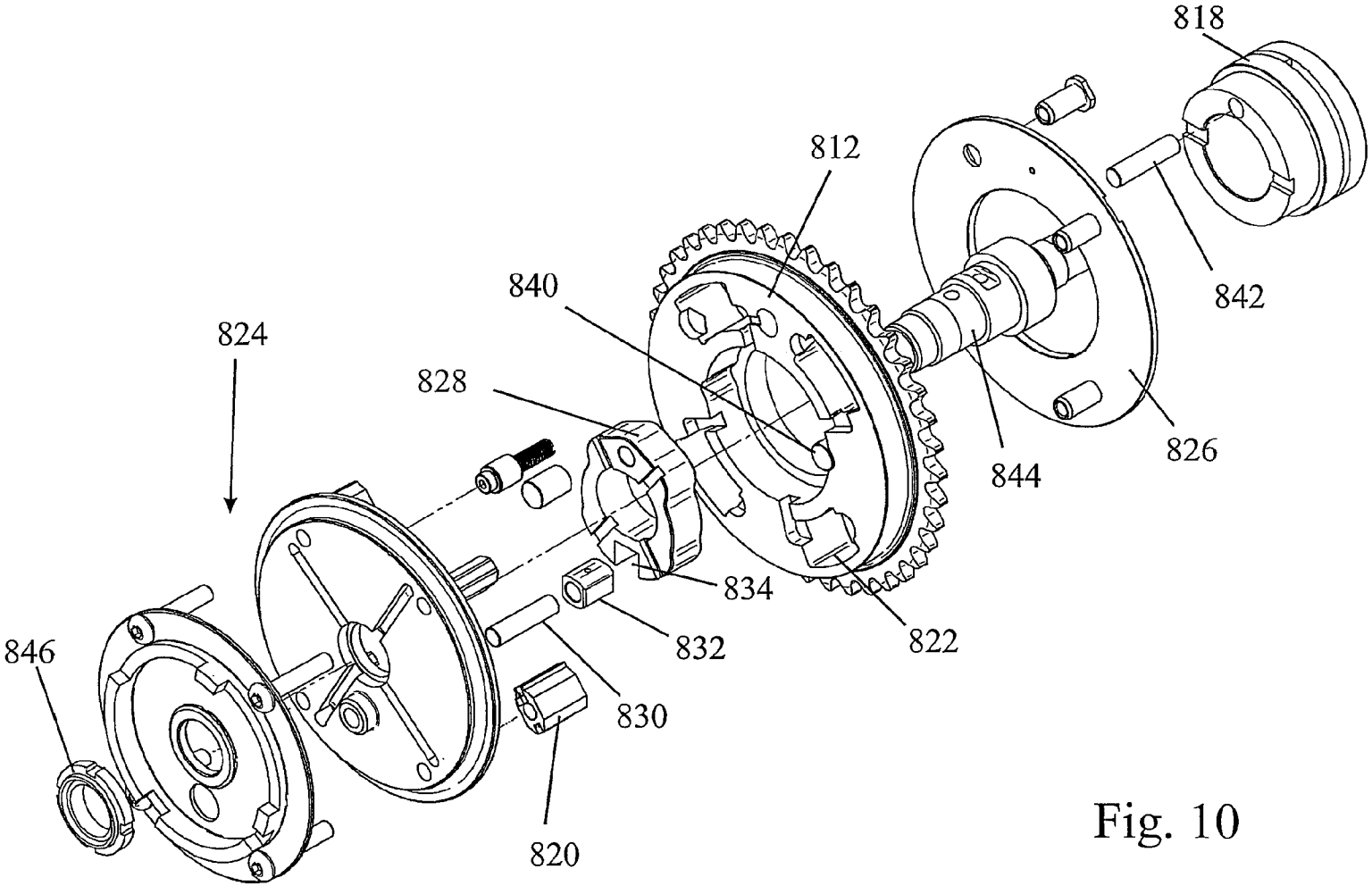
FIG. 10 is an exploded isometric view of a further embodiment of the invention.
Figure 12A:
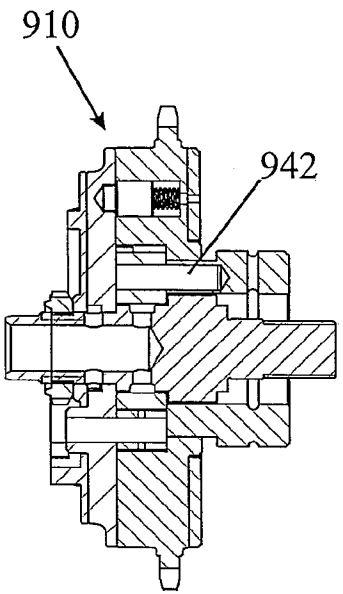
FIGS. 12A to C are similar view to FIGS. 11A to C showing a modification of the embodiment of FIG. 8, and FIGS. 13A and 13B show details of a still further embodiment of the invention in which pins act on cam slots in the yoke instead of its radially outer surface.
Figure 12C:
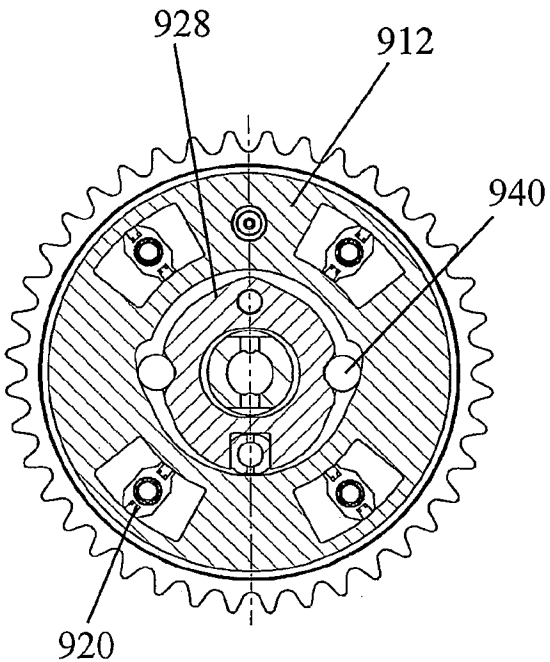
Figure 12B:
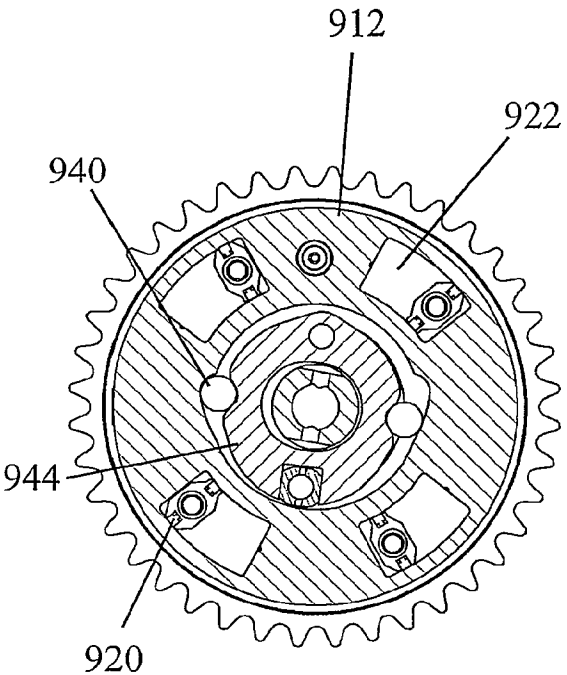

In the embodiment of FIGS. 10 and 11, the rollers 840 are retained in depressions in the inner surface of the drive member 812 and act on a contoured the outer surface of the yoke. An alternative configuration for this embodiment is shown in FIGS. 12A to 12C where the rollers 940 are located in depressions in the radially outwards facing surface of the yoke 928 and a contoured inner surface 913 of the drive member 912.

It would also be possible in this case to add a profile to the rollers 940 that matches the curvature of the profile on the yoke or drive member.

In all the embodiments described above the radially outwards facing surface of the yoke interacting with the drive member or the first driven member, as the case may be, has been its outer surface. This however need not be the case and it would be possible to form the yoke with one or more cam slots having radially outwards facing surfaces.

Figure 13B:
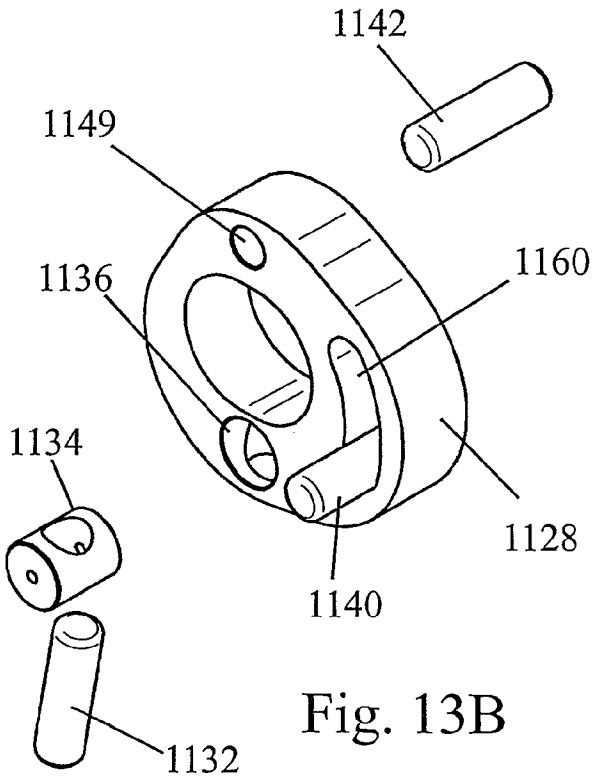
Figure 13A:
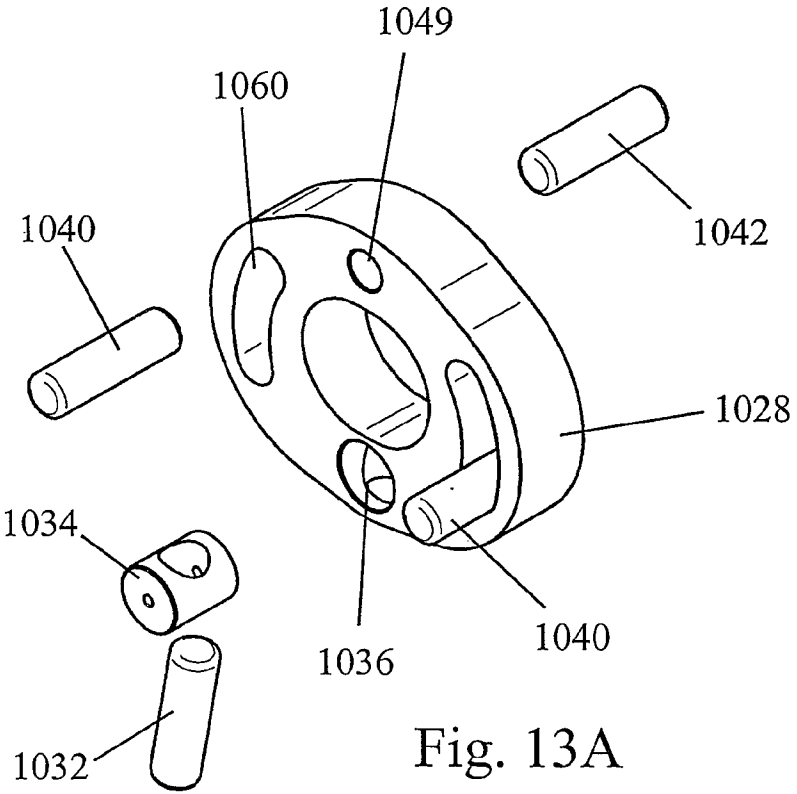

The yokes of two embodiments of the invention operating in the manner are shown in FIGS. 13A and 13B. In the embodiment of FIG. 13A there are two cam slots 1060 receiving pins 1040 while the embodiment of FIG. 13B has only a single cam slot 1160.

The various described embodiments of the invention have the following advantages when compared to existing designs:

They allow both intake and exhaust valve timing to be changed without two independent cam phasers and their control systems.

They provide a compact overall design that may be applied to both SCP camshaft and twin camshaft designs.

The design of the yoke and its associated components are considerably simplified, and They enable elimination of the effects of component tolerances by introducing graded components that allow the clearance of the yoke to be controlled.

The invention claimed is:

1. A variable phase mechanism, comprising a drive member rotatable about an axis, first and second driven members rotatable in synchronism with the drive member, an actuator for rotating the first driven member relative to the drive member to vary the phase of rotation of the first driven member relative to the drive member, and a yoke coupling the second driven member for rotation with one of the drive member and the first driven member and movable transversely relative to the axis of the drive member to vary the phase of rotation of the second driven member relative to the drive member, wherein transverse movement of the yoke is effected by means of interaction between the other of the drive member and the first driven member and a radially outwards facing surface defined by the yoke.

2. A variable phase mechanism as claimed in claim 1, wherein the radially outwards facing contoured surface is defined by the radially outer surface of the yoke.

3. A variable phase mechanism as claimed in claim 1, wherein the radially outwards facing contoured surface is defined by a cam slot formed in the face of the yoke.

4. A variable phase mechanism as claimed in claim 1, wherein the actuator for rotating the first driven member relative to the drive member comprises one or more hydraulically operated vanes located within arcuate working chambers.

5. A variable phase mechanism as claimed in claim 1, when fitted to an SCP camshaft assembly, wherein the two driven members are each connected to a respective one of the inner shaft and outer tube of the camshaft assembly.

6. A variable phase mechanism as claimed in claim 5, wherein the first driven member is connected to the inner shaft and second driven member is connected for rotation with the outer tube of the SCP camshaft assembly.

7. A variable phase mechanism as claimed in claim 1, in combination with two camshafts arranged parallel to one another, wherein the mechanism is mounted on a first camshaft and is connected to the second camshaft via a secondary drive gear or sprocket.

8. A variable phase mechanism as claimed in claim 7, wherein the first driven member is directly connected to the first camshaft upon which the mechanism is mounted and the second driven member is used to transmit drive to the second camshaft.

9. A variable phase mechanism as claimed in claim 7, wherein the interaction with a contoured surface of the yoke is effected by means of pins on said other of the drive member and the first driven member.

10. A variable phase mechanism as claimed in claim 9, wherein the pins support sleeves that are able to roll around the contoured surface of the yoke.

11. A variable phase mechanism as claimed in claim 10, wherein the sleeves contacting the contoured surface of the yoke are graded in order to compensate for the effect of manufacturing tolerances.

12. A variable phase mechanism as claimed in claim 9, wherein the contoured surface of the yoke that contacts the pins has a substantially constant curvature.

13. A variable phase mechanism as claimed in claim 12, wherein the pins support sleeves that are profiled to match the curvature of a contoured surface of the yoke.

14. A variable phase mechanism as claimed in claim 13, wherein the sleeves contacting a contoured surface of the yoke are graded in order to compensate for the effect of manufacturing tolerances.

15. A variable phase mechanism as claimed in claim 1, wherein the interaction with the contoured surface of the yoke is effected by means of rollers that contact both the contoured surface of the yoke and an inner surface of one of the drive member and the first driven member, the position of the rollers being dictated by the position of the first driven member relative to the drive member.

16. A variable phase mechanism as claimed in claim 15, wherein the said inner surface of said one of the driver member and the first driven member is cylindrical and the motion of the yoke is determined by the contoured surface of the yoke.

17. A variable phase mechanism as claimed in claim 15, wherein the contoured surface of the yoke is cylindrical and the motion of the yoke is determined by the profile of the said inner surface of said one of the driver member and the first driven member.

* * * * *